US008197217B2

(12) United States Patent
Yamamoto et al.

(10) Patent No.: US 8,197,217 B2
(45) Date of Patent: Jun. 12, 2012

(54) AXIAL FLOW FAN

(75) Inventors: Jiro Yamamoto, Sakai (JP); Masahiro Shigemori, Sakai (JP); Koji Somahara, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 1170 days.

(21) Appl. No.: 11/997,380

(22) PCT Filed: Jul. 31, 2006

(86) PCT No.: PCT/JP2006/315108

§ 371 (c)(1),
(2), (4) Date: Jan. 30, 2008

(87) PCT Pub. No.: WO2007/015444

PCT Pub. Date: Feb. 8, 2007

(65) Prior Publication Data

US 2010/0092286 A1 Apr. 15, 2010

(30) Foreign Application Priority Data

Aug. 1, 2005 (JP) ..... 2005-222574

(51) Int. Cl.
*F04D 29/38* (2006.01)

(52) U.S. Cl. ..... 416/228; 415/220

(58) Field of Classification Search ..... 416/189, 416/228; 415/220

See application file for complete search history.

(56) References Cited

U.S. PATENT DOCUMENTS

| | | | | |
|---|---|---|---|---|
| 1,041,913 | A * | 10/1912 | Tyson | 416/236 R |
| 4,664,593 | A | 5/1987 | Hayashi et al. | |
| 5,215,441 | A * | 6/1993 | Evans et al. | 416/223 R |
| 5,226,783 | A | 7/1993 | Mita | |
| 6,796,771 | B2 * | 9/2004 | Suzuki | 416/228 |
| 6,994,523 | B2 * | 2/2006 | Eguchi et al. | 416/228 |

FOREIGN PATENT DOCUMENTS

| | | | |
|---|---|---|---|
| DE | 41 24 891 | A | 2/1992 |
| EP | 1 382 856 | A1 | 1/2004 |
| JP | H02-085898 | U | 7/1990 |
| JP | 04-86399 | A | 3/1992 |
| JP | 2000-018194 | A | 1/2000 |
| JP | 2003-013892 | A | 1/2003 |
| JP | 2004-197694 | A | 7/2004 |
| JP | 3629702 | B2 | 12/2004 |
| JP | 2005-105865 | A | 4/2005 |

OTHER PUBLICATIONS

Supplementary European Search Report of corresponding EP Application No. 06 78 1986.2 dated May 12, 2011.

* cited by examiner

*Primary Examiner* — Ninh H Nguyen
(74) *Attorney, Agent, or Firm* — Global IP Counselors

(57) ABSTRACT

An axial flow fan is configured to allow leakage flows in regions near rear edges of bent portions formed by bending outer peripheries of blades towards negative pressure surfaces to smoothly flow out to reduce the vortex scale of the leakage flows themselves and to be able to effectively control turbulence of the flows. The axial flow fan includes a bellmouth and blades, with outer peripheries of the blades being bent towards negative pressure surfaces, wherein in regions near rear edges of bent portions that are bent towards the negative pressure surfaces, there are disposed second bent portions formed by bending part of the bent portions further towards the negative pressure surfaces.

4 Claims, 20 Drawing Sheets

AXIAL FLOW FAN

CROSS-REFERENCE TO RELATED APPLICATIONS

This U.S. National stage application claims priority under 35 U.S.C. §119(a) to Japanese Patent Application No. 2005-222574, filed in Japan on Aug. 1, 2005, the entire contents of which are hereby incorporated herein by reference.

BACKGROUND OF THE INVENTION

1. Field of the Invention

The present invention relates to the structure of an axial flow fan such as a propeller fan.

2. Background Information

Axial flow fans such as propeller fans, for example, are commonly used as blowers in outdoor units for air conditioners. FIG. 11 shows an example of the configuration of an outdoor unit for an air conditioner employing an axial flow fan such as a propeller fan as a blower unit.

That is, as shown in FIG. 11, for example, in an outdoor unit for an air conditioner, a blower unit 3 is configured by a propeller fan 4 that is an example of an axial flow fan, a bellmouth 5 that is positioned on the outer peripheral side of the propeller fan 4 and partitions the propeller fan 4 into a rear suction region X of the propeller fan 4 and a front blowout region Y, and a fan guard 6 that is positioned on the blowout side (front side) of the propeller fan 4. The blower unit 3 is disposed inside a box-like body casing 1 on an airflow downstream side of a heat exchanger 2 in a backside air suction opening 10*a*. Reference numeral 12 is a fan motor that drives the propeller fan 4 to rotate, and the fan motor is supported by and fixed to an unillustrated fan motor attachment bracket disposed so as to be positioned on the downstream side of the heat exchanger 2.

Additionally, the propeller fan 4 is configured by a hub 14 that is coupled and fixed to a drive shaft 12*a* of the fan motor 12 and which, as shown in enlarged view in FIG. 12 and FIG. 13, for example, serves as the rotational center of the propeller fan 4 and by plural blades 13, 13, 13 that are disposed integrally on the outer peripheral surface of the hub 14.

In the case of an outdoor unit of this structure, there is the drawback that noise during operation becomes higher because of noise from the propeller fan 4 itself and also noise generated as a result of the blowout airflow from the propeller fan 4 colliding with downstream structural objects such as the fan guard 6.

Thus, in order to reduce the total noise when an axial flow fan such as the propeller fan 4 is utilized as a blower in an outdoor unit for an air conditioner as described above, measures and considerations have heretofore been performed, such as optimizing the shape of the wing surfaces of the blade portion of the propeller fan and making airfoil wings having excellent aerodynamic performance, for example. However, the following problems cannot be solved just by these silencing techniques.

That is, in the blade structure of the propeller fan 4 shown in FIG. 13, for example, when the blades 13, 13, 13 rotate, airflows (P) that wind around from pressure surfaces 13*d* where pressure is high towards negative pressure surfaces 13*e* where pressure is low occurs on the outer peripheral sides of the blades 13, 13, 13, and wing tip vortexes (Q) such as shown in the drawing are formed by those airflows (P). Additionally, turbulence of the blowout airflows resulting from the wing tip vortexes (Q) occurring due to the airflows (P) that wind around from the blowout side towards the suction side near outer peripheral portions of the blades 13, 13, 13 becomes layered, gradually grows and increases downstream as shown in FIG. 14 and FIG. 15, for example, eventually separates from the negative pressure surfaces 13*e* of the blades 13, 13, 13, and interferes with the pressure surfaces 13*d*, 13*d* of the blades 13, 13 and 13 that are adjacent and the inner peripheral surface of the bellmouth 5 or the fan guard 6 that is a structural object on the downstream side of the blower, which further increases noise.

In particular, as shown in FIG. 15, the wing tip vortexes (Q) that have separated from the negative pressure surfaces 13*e* of the blades 13, 13, 13 interfere with the adjacent blades 13, 13, 13 as described above, whereby the turbulence becomes even greater and, as a result, causes an even greater amount of noise on the downstream side of the blower.

With respect to this phenomenon, when the wing chord length of the blades 13, 13, 13 is shortened in order to make the blower lightweight (low-cost), the inherent wing row effect of the blades 13, 13, 13 becomes smaller, so as shown in FIG. 16, for example, it becomes easier for the wing tip vortexes (Q) to move even farther from the negative pressure surfaces 13*e* and interfere with the adjacent blades 13, 13, 13 even earlier than in the above-described case, so it becomes easier for the amount of noise to increase even more.

In relation to this, as shown in FIG. 17, for example, there is an axial flow fan where entire outer peripheral portions 13*c* from front edges 13*a* of the blades 13, 13, 13 to rear edges 13*b* thereof are bent towards the negative pressure sides (suction sides) (by disposing folded portions or bent portions) and where the radial direction width of the bent portions 13*c* is gradually made larger from the front edges 13*a* to the rear edges 13*b* (e.g., Japanese Patent Publication No. 3,629,702).

According to this configuration, as shown in FIG. 18 and FIG. 19, for example, the airflows (P) on the pressure surface 13*d* sides of the blades 13, 13, 13 wind around into outer peripheral end concave circular arc-shaped negative pressure surfaces 13*e* of the blades 13, 13, 13 smoothly along outer peripheral end convex circular arc-shaped pressure surfaces 13*d* of the blades 13, 13, 13, the vortex diameters become small and stable, and the flows of the airflows (R) in the outer peripheral direction of the blades 13, 13, 13 on the negative pressure surfaces 13*e* no longer interfere with the wing tip vortexes (Q).

Additionally, with respect to this action, when the width of the bent portions 13*c* of the blade outer peripheral end portions 13*c* gradually becomes larger from the vicinities of the front edges 13*a* of the blades 13, 13, 13 towards the vicinities of the rear edges 13*b* as described above, the blades come to smoothly exhibit an effect from the front edges 13*a* to the rear edges 13*b* in correspondence to the vortex diameters of the wing tip vortexes (Q) that gradually develop and whose vortex diameters are enlarged from the front edges 13*a* of the blades 13 to the rear edges 13*b*, and it also becomes difficult for the generated wing tip vortexes (Q) to separate from the blade negative pressure surfaces 13*e*.

For that reason, even when the wing chord length has been shortened in order to make the blades 13, 13, 13 lightweight, for example, the wing tip vortexes (Q) no longer interfere with each other between the adjacent blades 13, 13, 13, and there is also less turbulence in the blowout airflows on the downstream side of the blower.

As a result, noise when the axial flow fan is incorporated in an outdoor unit for an air conditioner also becomes effectively reduced.

However, in a case where the rear edges 13*b* of the blades 13 of the fan impeller are surrounded by the bellmouth 5 as mentioned above, leakage flows (S) such as shown in FIG. 20 that pass through the gap between the bellmouth 5 and the outer peripheral portions of the blades and flow out from the pressure surfaces 13*d* to the negative pressure surfaces 13*e* exist separately from the wing tip vortexes (Q).

That is, the wing tip vortexes (Q) that leak from the negative pressure surfaces 13*e* of the blade outer peripheries to the pressure surface 13*d* as mentioned previously gradually develop from the front edges 13*a* of the blade outer peripheries towards the rear edges 13*b* along the negative pressure surfaces 13*e* of the blades 13. However, in the region where the blades 13 are surrounded by the bellmouth 5, the flows along the negative pressure surfaces 13*e* suddenly change their trajectories in a direction away from the negative pressure surfaces 13*e* (see the one-dotted chain lines in FIG. 20).

One reason why the wing tip vortexes (Q) suddenly change their trajectories in this manner is because of the presence of the leakage flows (S) that pass through the gap between the outer peripheral portions of the blades 13 and the bellmouth 5 and flow out from the pressure surfaces 13*d* of the blades 13 to the negative pressure surfaces 13*e*.

The leakage flows (S) arise in the portion surrounded by the bellmouth 5. Additionally, the leakage flows (S) become stronger particularly at the portion of the bellmouth 5 that is straight in the axial direction of the air suction opening in the bellmouth 5, and the turbulence of the flows becomes stronger downstream.

With respect thereto, the turbulence of the flows resulting from such leakage flows (S) cannot be sufficiently reduced simply by disposing the bent portions 13*c* in the blade outer peripheral portions as in the above-described conventional example. Additionally, the leakage flows (S) eventually cause turbulence at the outer peripheral portions of the rear edges 13*b* of the negative pressure surfaces 13*e* and result in a rise in noise.

Moreover, because the leakage flows (S) flow out in the direction of the wing tip vortexes (Q) from the outer peripheral ends of the blades 13, they also play the role of causing the wing tip vortexes (Q) to approach the following wings. As a result, there is also the potential for interference with the following wings.

Further, the leakage flows (S) merge together with the wing tip vortexes (Q), and the scale of the turbulence of the wing tip vortexes (Q) becomes larger and forms an even larger turbulence region near the outer peripheral portions of the rear edges 13*b* of the blade negative pressure surfaces 13*e*.

Particularly in the case of a high static pressure type of fan where the axial direction length of the bellmouth 5 is large, these problems become more pronounced because it becomes easier for the scale of the turbulence resulting from the leakage flows (S) to become larger.

In other words, it is difficult to sufficiently control the turbulence and change in the trajectories of the wing tip vortexes (Q) that the above-described leakage flows (S) create with just the conventional bent portions 13*c* on the blade outer peripheral portions. Additionally, stably creating such wing tip vortexes (Q) near the negative pressure surfaces 13*e* has been insufficient, which has caused a rise in blowing noise.

The present invention has been devised in order to solve this problem, and it is an object thereof to provide an axial flow fan configured such that parts of the bent portions bent towards negative pressure surfaces of blade outer peripheries are further bent towards the negative pressure surfaces in regions near rear edges thereof, to thereby allow the aforementioned leakage flows to smoothly flow out downstream to reduce the vortex scale of the aforementioned leakage flows themselves and to be able to effectively control turbulence of the flows.

SUMMARY OF THE INVENTION

In order to achieve this object, the present invention is configured to include the following effective problem solving means.

According to a first aspect of the present invention, an axial flow fan includes a bellmouth 5 and blades 13, with outer peripheries of the blades 13 being bent towards negative pressure surfaces 13*e*, wherein in regions near rear edges of bent portions 13*c* that are bent towards the negative pressure surfaces 13*e*, there are disposed second bent portions 13*f* formed by bending part of the bent portions 13*c* further towards the negative pressure surfaces 13*e*.

According to this configuration, first, the outer peripheral portions of the blades 13 are bent towards the negative pressure surfaces 13*e*, so the airflows (P) on pressure surfaces 13*d* of the blades 13 wind around into the outer peripheral end concave negative pressure surfaces 13*e* of the blades 13 smoothly along the outer peripheral end convex pressure surfaces 13*d* of the blades 13, the vortex diameters become smaller and stable, and the flows of the airflows (R) in the outer peripheral direction of the blades 13 on the negative pressure surfaces 13*e* no longer interfere with the wing tip vortexes (Q).

Additionally, in that case, in this configuration, the second bent portions 13*f* are also disposed, whereby the axial flow fan becomes able to allow the aforementioned leakage flows (S) that pass through the gaps between the bellmouth 5 and the blade outer peripheral portions and flow out from the pressure surfaces 13*d* towards the negative pressure surfaces 13*e* to smoothly flow out towards the downstream sides of the blades, so the axial flow fan can reduce the vortex diameters thereof and control turbulence of the flows.

Moreover, by controlling the leakage flows (S) in this manner, the axial flow fan can also control the wing tip vortexes (Q) from approaching the following wings. Further, the axial flow fan can also control an increase in the strength of turbulence formed as a result of the leakage flows (S) and the wing tip vortexes (Q) merging together and an enlargement in the region of turbulence.

As a result, the axial flow fan can realize, as much as possible, a reduction in blowing noise and greater efficiency.

According to a second aspect of the present invention, an axial flow fan of the first aspect of the present invention, wherein the bent portions 13*c* that are bent towards the negative pressure surfaces are disposed across the entire bodies of the blades 13 from front edges 13*a* thereof to rear edges 13*b* thereof.

According to this configuration, first, the entire outer peripheral portions of the blades 13 from the front edges 13*a* to the rear edges 13*b* thereof are bent towards the negative pressure surfaces 13*e*, so the airflows (P) on the pressure surfaces 13*d* of the blades 13 wind around into the outer peripheral end concave negative pressure surfaces 13*e* of the blades 13 smoothly along the outer peripheral end convex pressure surfaces 13*d* of the blades 13, the vortex diameters become smaller and stable, and the flows of the airflows (R) in the outer peripheral direction of the blades 13 on the negative pressure surfaces 13*e* no longer interfere with the wing tip vortexes (Q).

Additionally, in that case, in this configuration, the second bent portions 13*f* are also disposed, whereby the axial flow fan becomes able to allow the aforementioned leakage flows (S) that pass through the gaps between the bellmouth and the blade outer peripheral portions and flow out from the pressure surfaces 13*d* towards the negative pressure surfaces 13*e* to smoothly flow out towards the downstream sides of the blades, so the axial flow fan can reduce the vortex diameters thereof and control turbulence of the flows.

Moreover, by controlling the leakage flows (S) in this manner, the axial flow fan can also control the wing tip vortexes (Q) from approaching the following wings. Further, the axial flow fan can also control an increase in the strength of turbulence formed as a result of the leakage flows (S) and the wing tip vortexes (Q) merging together and an enlargement in the regions of turbulence.

As a result, the axial flow fan can realize, as much as possible, a reduction in blowing noise and greater efficiency.

According to a third aspect of the present invention, an axial flow fan of the first aspect of the present invention, wherein the bent portions 13*c* that are bent towards the negative pressure surfaces are disposed across the blades 13 from a predetermined position between front edges 13*a* thereof and rear edges 13*b* thereof to the rear edges 13*b*.

According to this configuration, first, the outer peripheral portions of the blades 13 from a predetermined position between the front edges 13*a* thereof and the rear edges 13*b* thereof to the rear edges 13*b* are bent towards the negative pressure surfaces 13*e*, so substantially similar to the case of the second invention, the airflows (P) on the pressure surfaces 13*d* of the blades 13 wind around into the outer peripheral end concave negative pressure surfaces 13*e* of the blades 13 smoothly along the outer peripheral end convex pressure surfaces 13*d* of the blades 13, the vortex diameters become smaller and stable, and the flows of the airflows (R) in the outer peripheral direction of the blades 13 on the negative pressure surfaces 13*e* no longer interfere with the wing tip vortexes (Q).

Additionally, in that case, in this configuration, the second bent portions 13*f* are also disposed, whereby the axial flow fan becomes able to allow the aforementioned leakage flows (S) that pass through the gaps between the bellmouth and the blade outer peripheral portions and flow out from the pressure surfaces 13*d* towards the negative pressure surfaces 13*e* to smoothly flow out towards the downstream sides of the blades, so the axial flow fan can reduce the vortex diameters thereof and control turbulence of the flows.

Moreover, by controlling the leakage flows (S) in this manner, the axial flow fan can also control the wing tip vortexes (Q) from approaching the following wings. Further, the axial flow fan can also control an increase in the strength of turbulence formed as a result of the leakage flows (S) and the wing tip vortexes (Q) merging together and an enlargement in the regions of turbulence.

As a result, the axial flow fan can realize, as much as possible, a reduction in blowing noise and greater efficiency.

According to a fourth aspect of the present invention, an axial flow fan of the first aspect of the present invention, wherein a radial direction width of the bent portions 13*c* that are bent towards the negative pressure surfaces is formed so as to become larger towards rear edges 13*b*.

In this manner, when the radial direction width of the bent portions 13C is formed so as to become larger towards the rear edges 13*b*, the blades come to smoothly exhibit an effect from the front edges 13*a* thereof to the rear edges 13*b* thereof in correspondence to the vortex diameters of the wing tip vortexes (Q) that are gradually increased and whose vortex diameters are enlarged from the front edges 13*a* of the blades 13 to the rear edges 13*b*, and it also becomes difficult for the generated wing tip vortexes (Q) to separate from the blade negative pressure surfaces 13*e*.

For that reason, even when the wing chord length has been shortened in order to make the blades 13 lightweight, for example, the wing tip vortexes (Q) no longer interfere with each other between the adjacent blades 13, 13, 13, and there is also less turbulence in the blowout airflows on the downstream side of the blower.

As a result, in this configuration, the aforementioned actions are effectively combined, so that noise when the axial flow fan is incorporated in an outdoor unit for an air conditioner becomes more effectively reduced.

According to a fifth aspect of the present invention, an axial flow fan of the first aspect of the present invention, wherein the second bent portions 13*f* are formed within the range of an axial direction length $L_0$ of the bellmouth 5 from a straight portion 5*a* to an outlet guide surface portion 5*c* excluding an inlet guide surface portion 5*b* of an air suction opening in the bellmouth 5.

The wing tip vortexes (Q) that develop from the front edges 13*a* of the blades 13 and the leakage flows (S) that pass through the gaps between the bellmouth 5 and the blades 13 merge together at the straight portion 5*a* of the air suction opening in the bellmouth 5, the trajectories of the wing tip vortexes (Q) suddenly change in a direction away from the negative pressure surfaces 13*e* at the inlet portion of the straight portion 5*a*, and thereafter the vortex scale of the wing tip vortexes (Q) becomes larger.

Moreover, the leakage flows (S) leak out in the direction of the wing tip vortexes (Q) from the outer peripheral ends of the blades 13, so they fulfill the roll of causing the wing tip vortexes (Q) to move towards the following wings. As a result, there is also the potential for interference with the following wings.

Thus, by disposing the second bent portions 13*f* within the range of the axial direction length $L_o$ of the bellmouth 5 from the straight portion 5*a* to the outlet guide surface portion 5*c* downstream of the inlet guide surface portion 5*b* of the air suction opening in the bellmouth 5 where the leakage flows (S) and the wing tip vortexes (Q) merge together, the axial flow fan allows the leakage flows (S) to flow out as smoothly as possible and reduces as much as possible the vortex scale of the aforementioned leakage flows. Additionally, due to this, the axial flow fan effectively controls the wing tip vortexes (Q) from separating from the wing negative pressure surfaces 13*e* and also effectively controls separation of the flows at the negative pressure surfaces 13*e* of the blade rear edges 13*b*.

As a result, the axial flow fan can realize a more effective blowing noise reduction and greater efficiency.

As described above, according to the axial flow fan of the present invention, the axial flow fan can effectively control the wing tip vortexes from separating from the wing negative pressure surfaces because of the leakage flows that pass through the gaps between the outer peripheral portions of the blades and the bellmouth and flow out from the pressure surfaces of the blades to the negative pressure surfaces.

Consequently, the axial flow fan can reduce as much as possible the scale of the wing tip vortexes on the final end of the impeller and can also effectively control separation of the flows at the negative pressure surfaces of the rear edges of the blades.

As a result, the axial flow fan can realize as effective a reduction in blowing noise as possible and greater efficiency of blowing performance.

DETAILED DESCRIPTION OF THE PREFERRED EMBODIMENTS

FIG. 1 to FIG. 10 show the configuration and action of an axial flow fan such as a propeller fan pertaining to the best mode for implementing the present invention.

Figure 6:
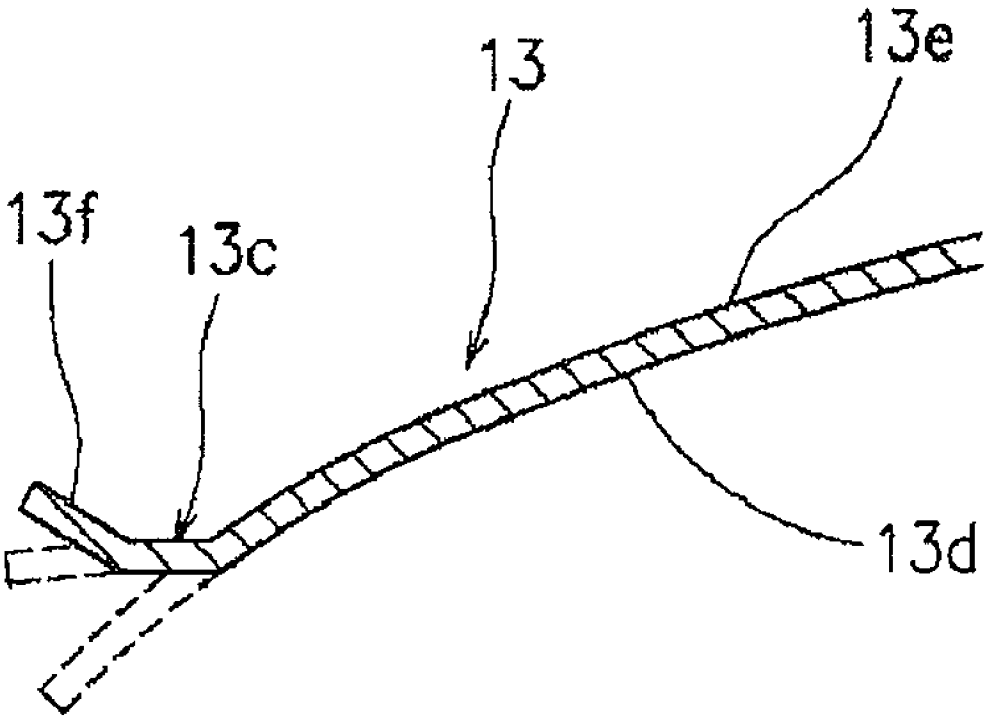
FIG. 6 is a cross-sectional view (cross-sectional view along A-A of FIG. 5) showing the shape of the relevant portion of the blade of the impeller portion.
Figure 7:
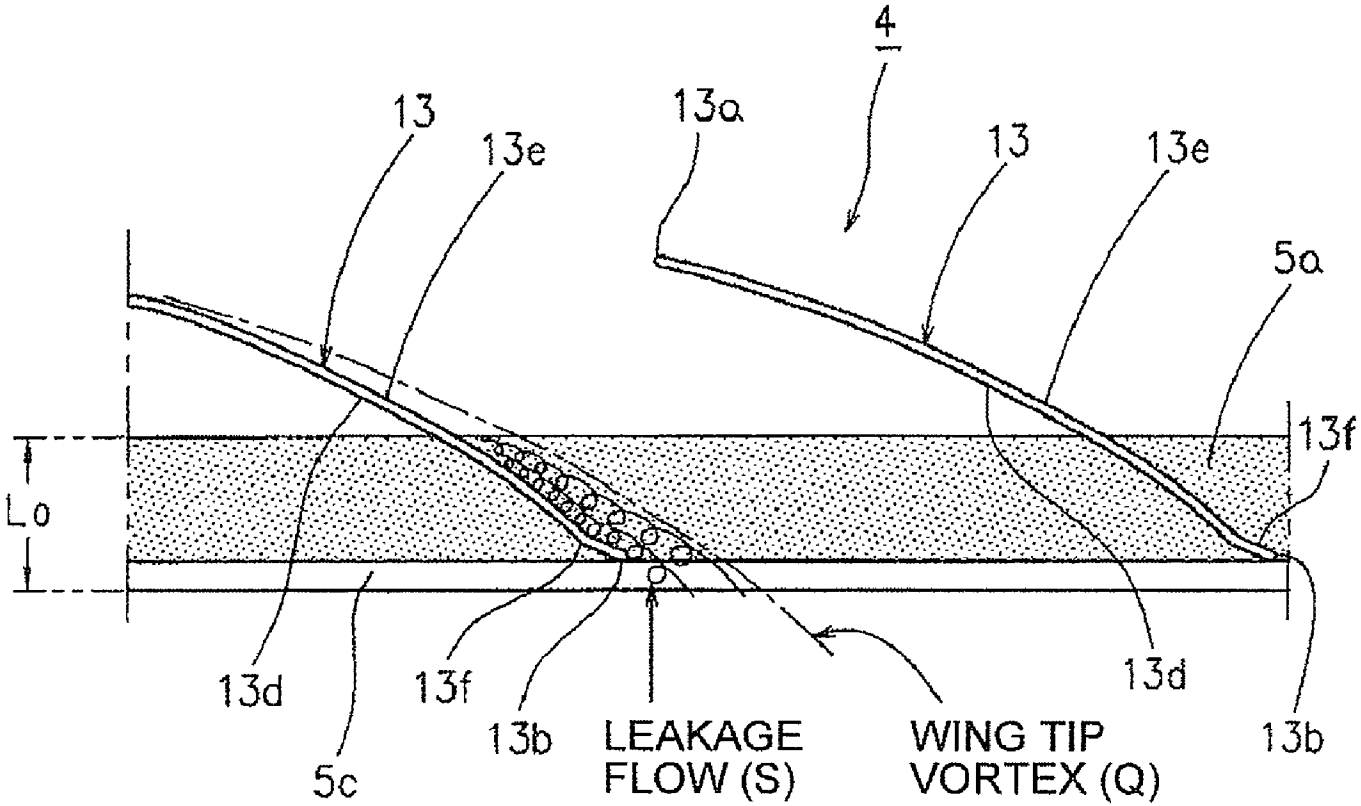
FIG. 7 is a descriptive view showing the action of the blade of the impeller portion.
Figure 8:
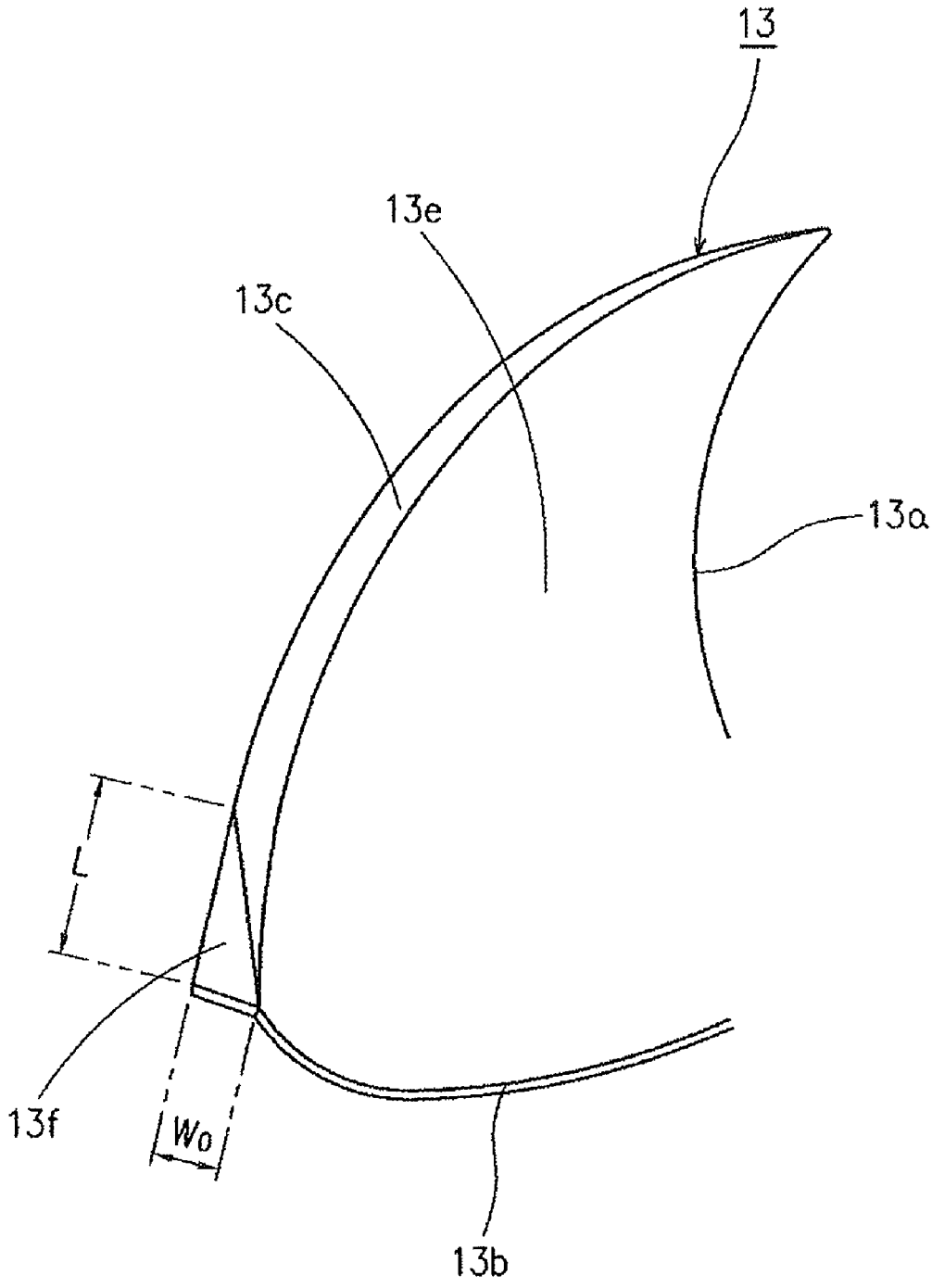
FIG. 8 is a plan view showing the shape of the relevant portion of a blade pertaining to a first modification of the best mode for implementing the present invention.
Figure 9:
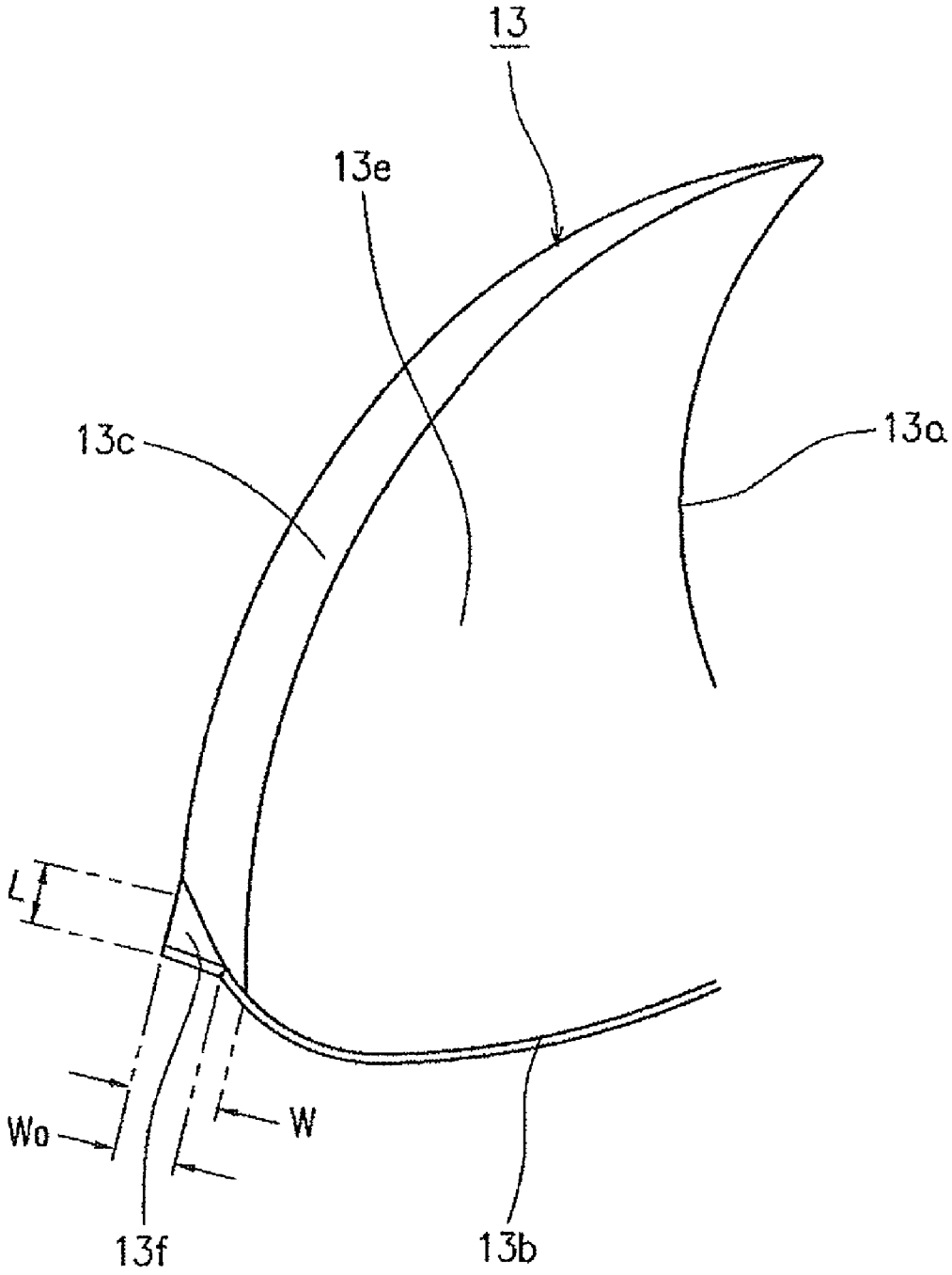
FIG. 9 is a plan view showing the shape of the relevant portion of a blade pertaining to a second modification of the best mode for implementing the present invention.
Figure 10:
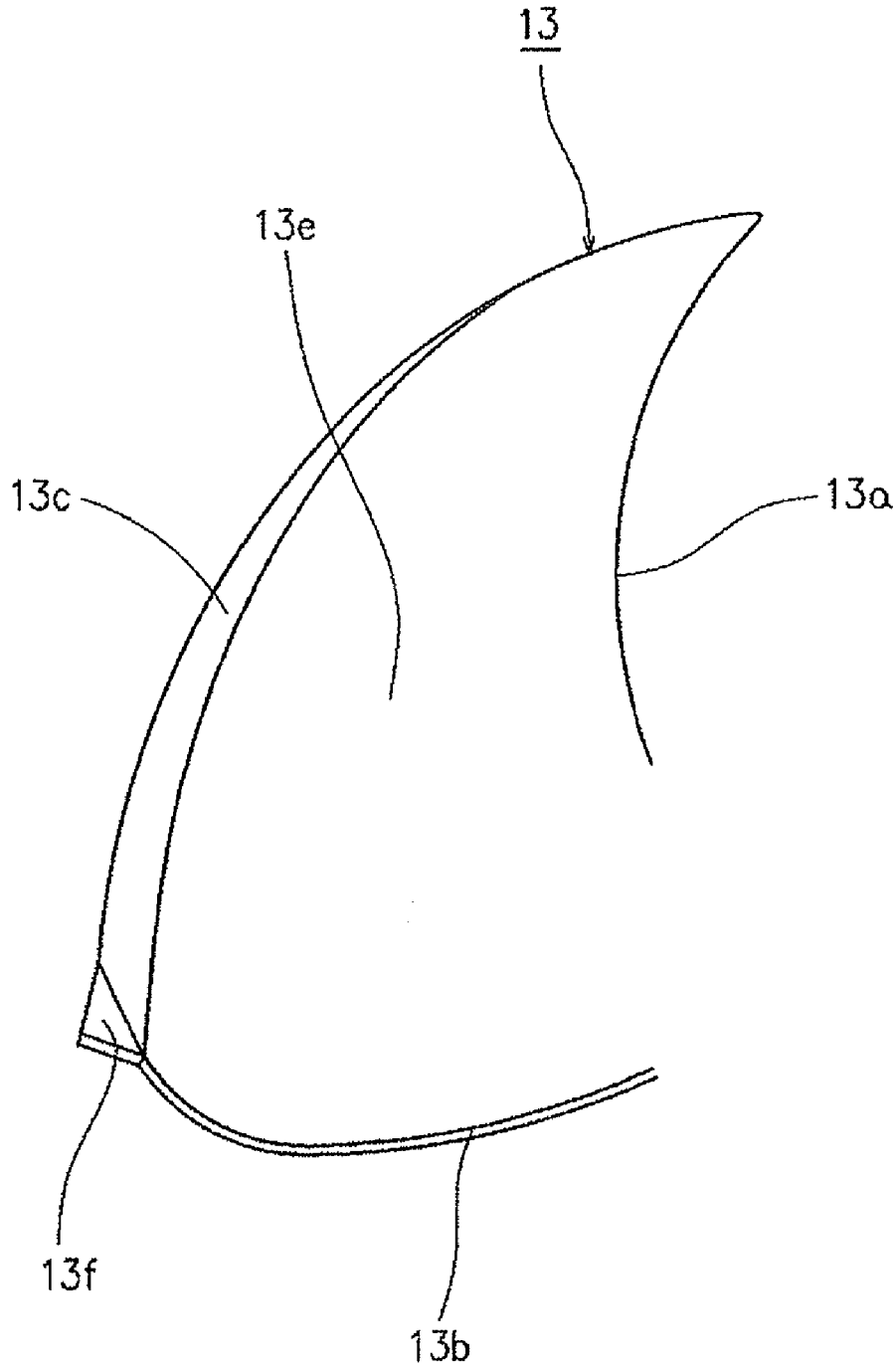
FIG. 10 is a plan view showing the shape of the relevant portion of a blade pertaining to a third modification of the best mode for implementing the present invention.
Figure 11:
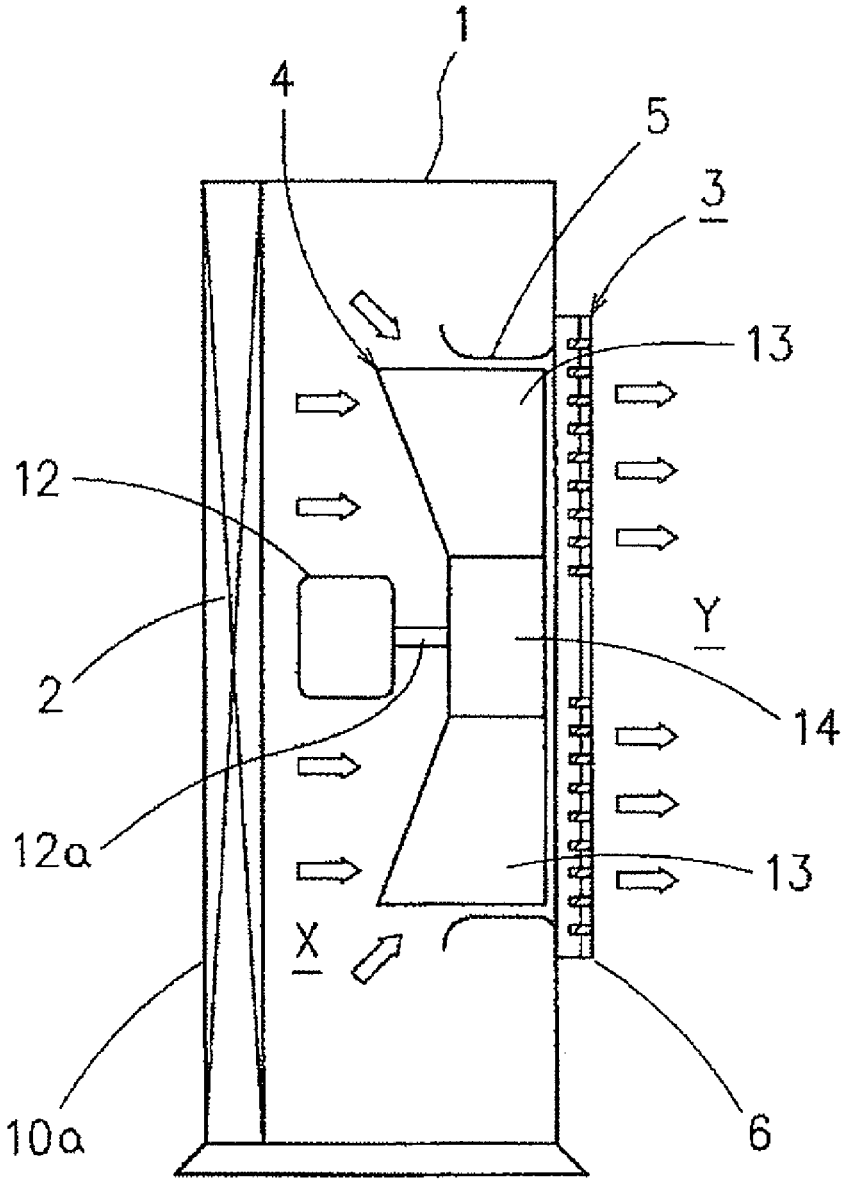
Prior Art Fig. 11
FIG. 11 is a longitudinal sectional view showing the configuration of an outdoor unit for an air conditioner employing a conventionally common propeller fan.
Figure 12:
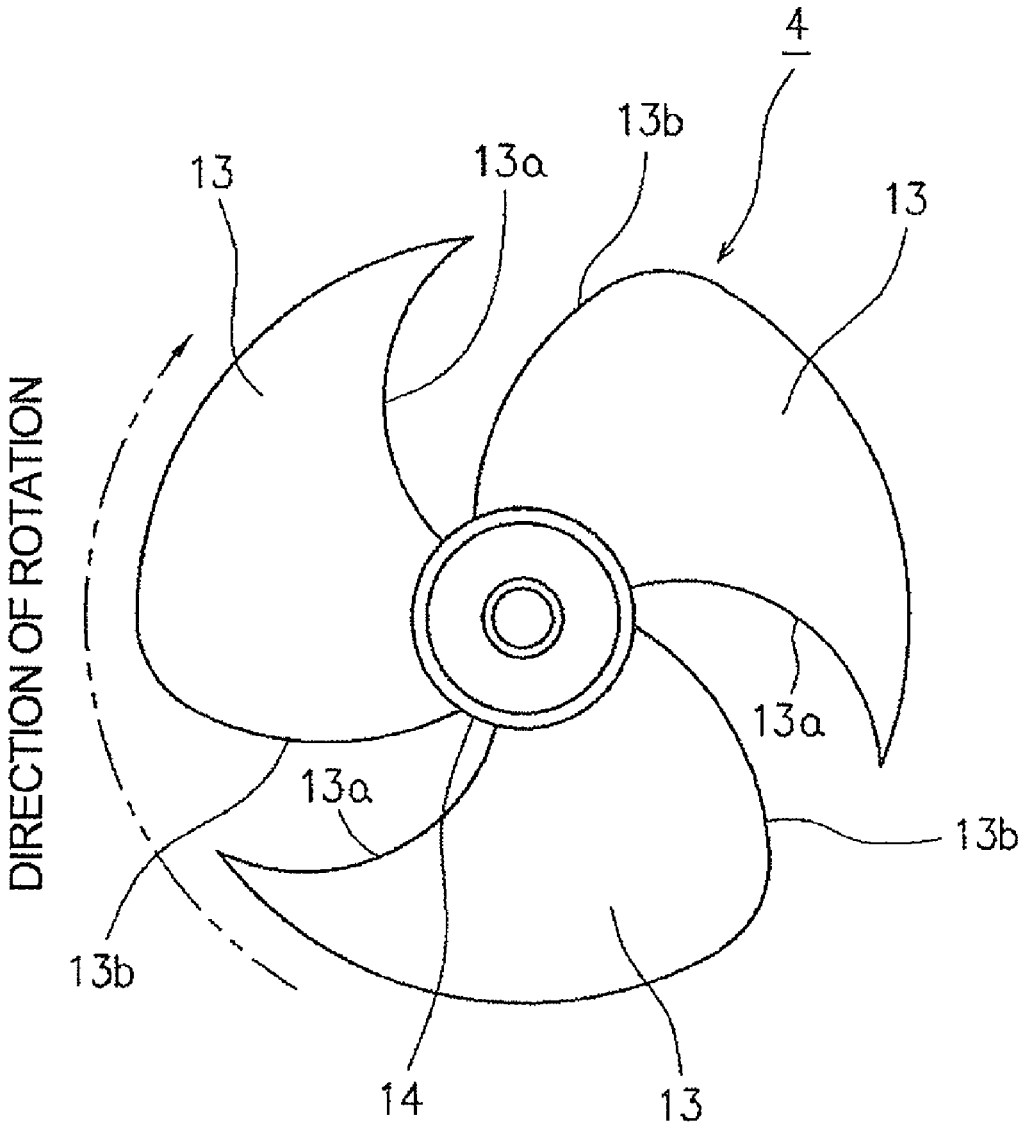
Prior Art Fig. 12
FIG. 12 is a rear view of the propeller fan employed in the conventionally common outdoor unit.
Figure 13:
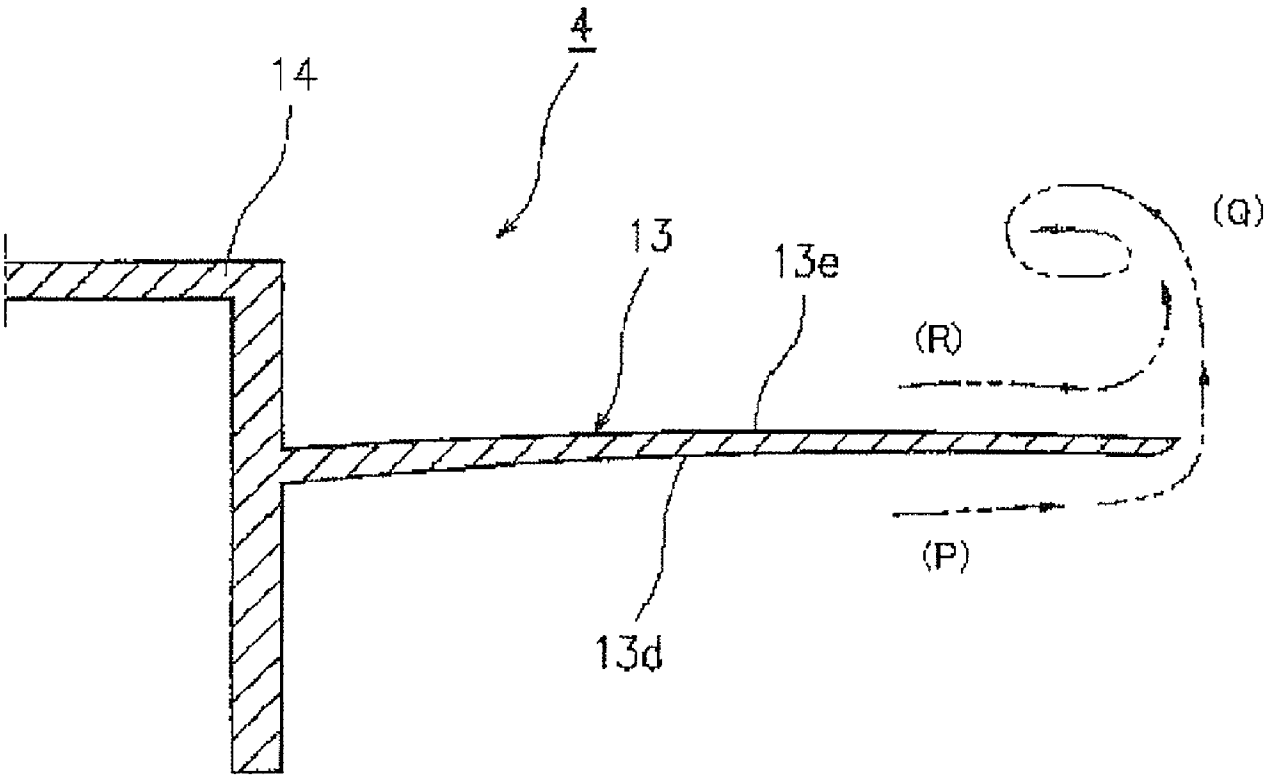
Prior Art Fig. 13
FIG. 13 is a cross-sectional view showing the cross-sectional structure of a blade portion of the conventionally common propeller fan and the action (problems) of the relevant portion thereof.
Figure 14:
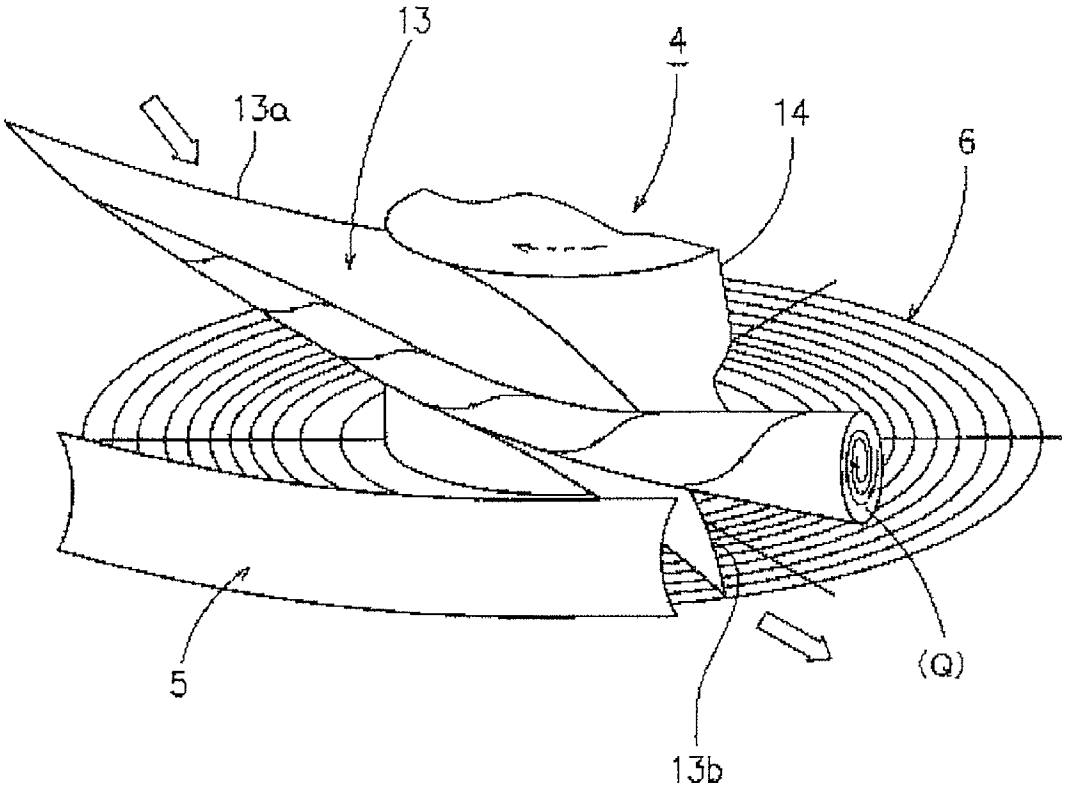
Prior Art Fig. 14
FIG. 14 is a general descriptive view showing a problem (wing tip vortex generating mechanism) in the relationship with the structure of the outdoor unit resulting from the conventionally common propeller fan.
Figure 15:
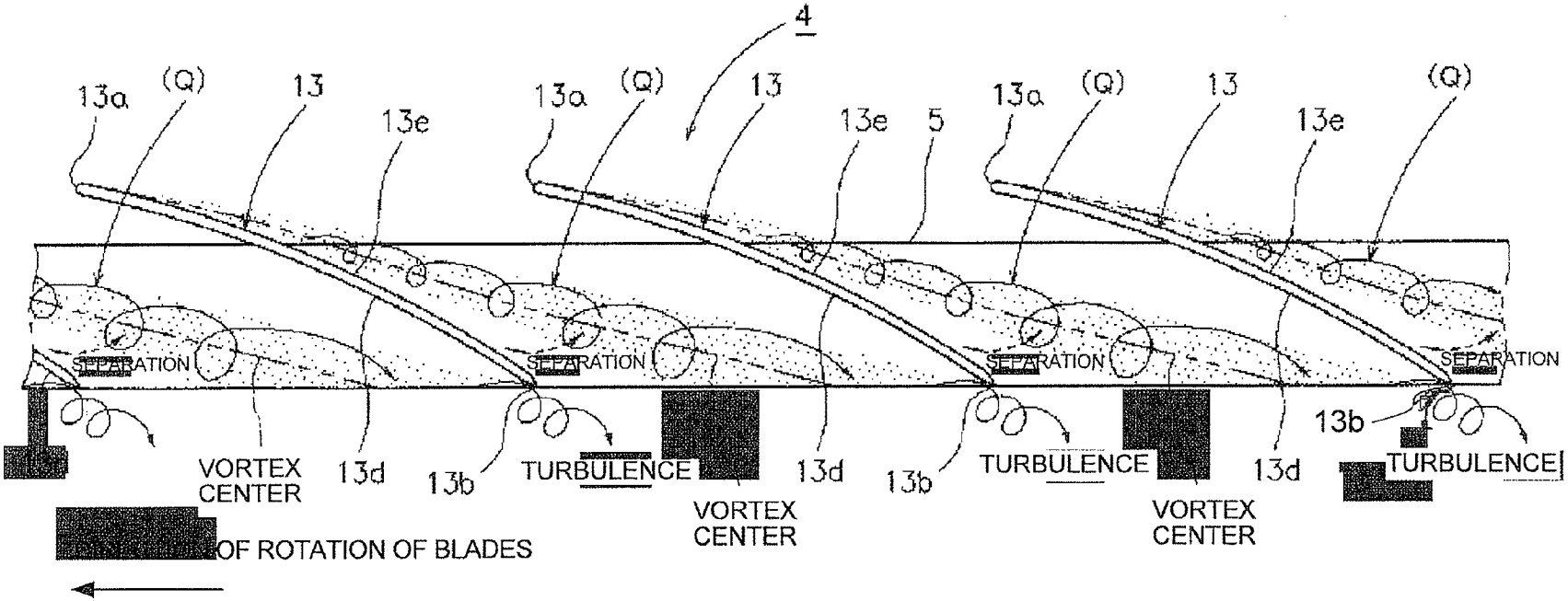
Prior Art Fig. 15
FIG. 15 is a general descriptive view showing a wing tip vortex interference phenomenon between adjacent wings of blades of the conventionally common propeller fan.
Figure 16:
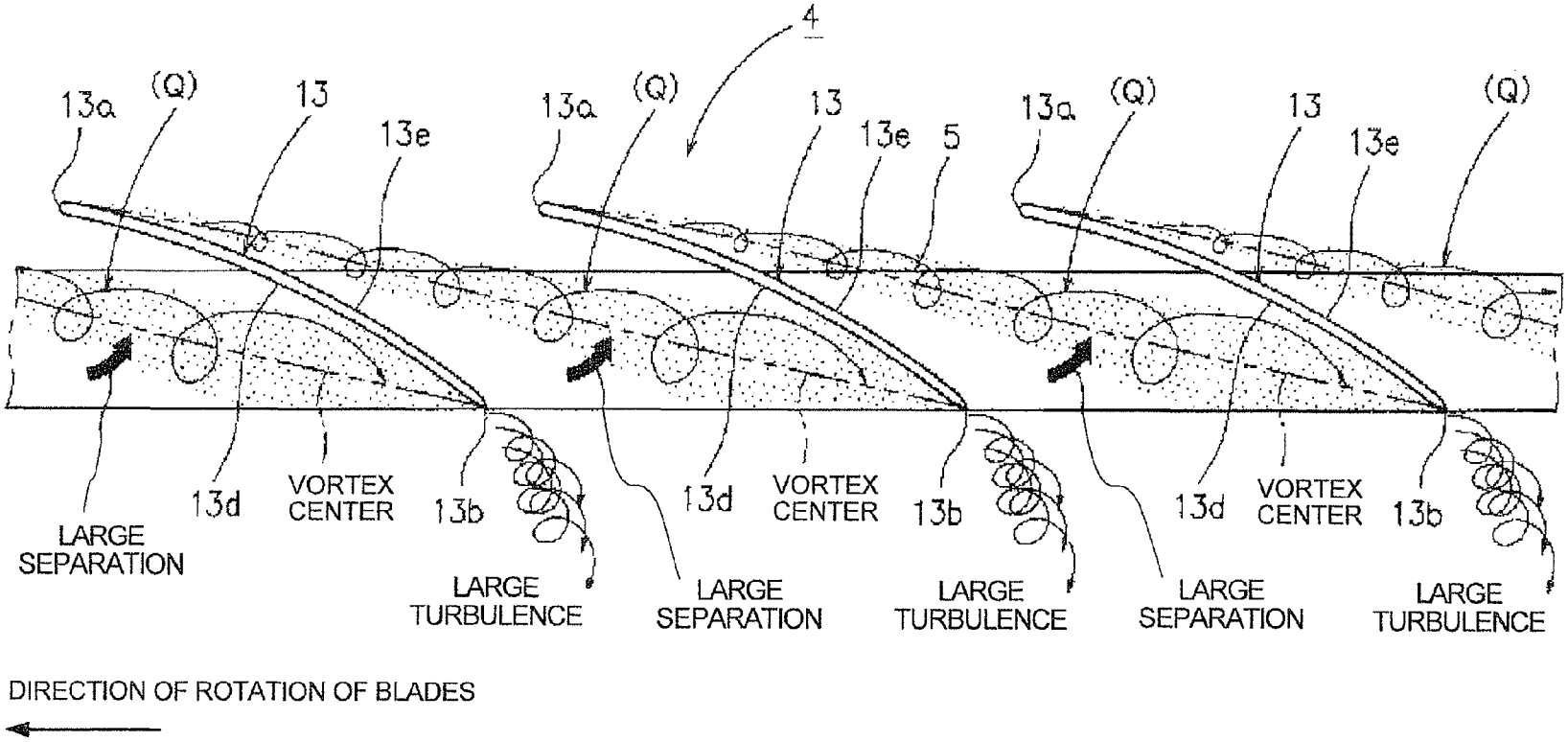
Prior Art Fig. 16
FIG. 16 is a general descriptive view showing a wing tip vortex interference state between adjacent wings when the wing chord length of the blades of the conventionally common propeller fan has been shortened.
Figure 17:
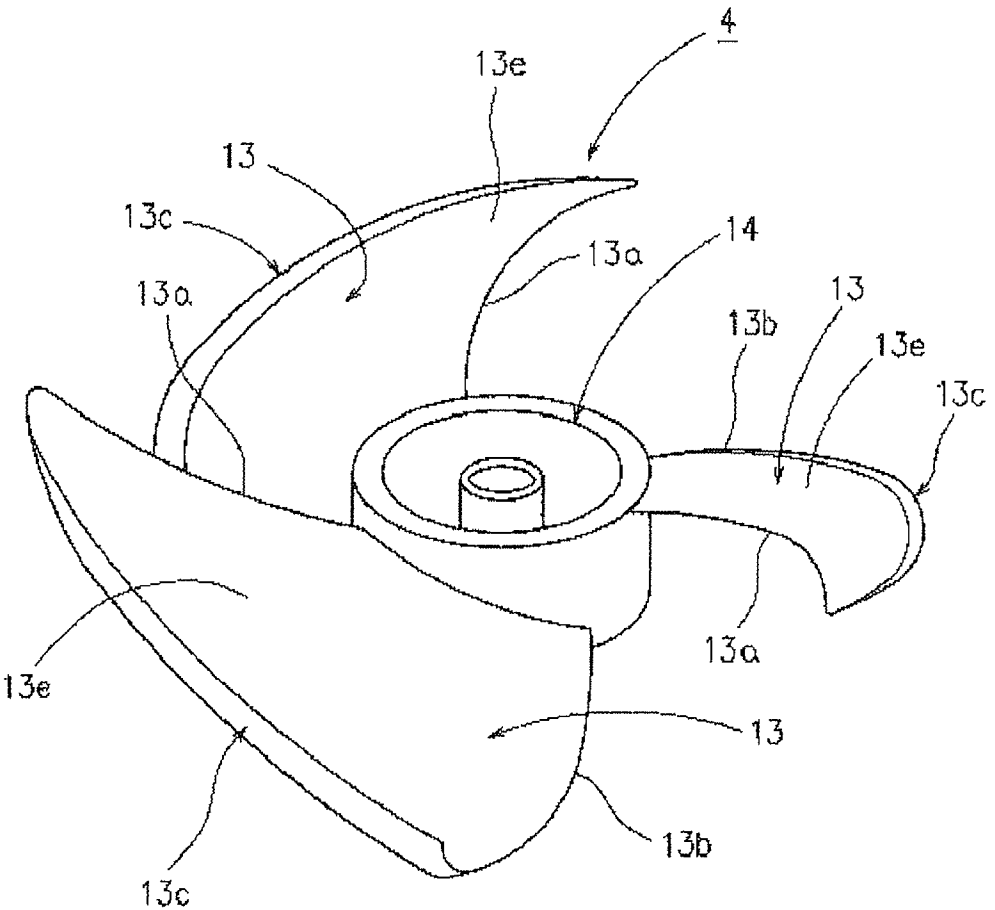
Prior Art Fig. 17
FIG. 17 is a perspective view showing the basic shape of the blades of the propeller fan pertaining to the conventional example dealing with the problems of FIG. 12 to FIG. 16.

First, FIG. 1 to FIG. 7 show the basic configuration and action of a blade portion of an impeller when a propeller fan 4 is employed as the same axial fan, and FIG. 8, FIG. 9 and FIG. 10 respectively show the configurations of first, second and third modifications of the same blade portion.

Basic Configuration of Fan Impeller Portion

First, in FIG. 1 to FIG. 6, reference numeral 14 is a hub that is made of a synthetic resin and serves as the rotational center of the propeller fan 4, and plural (three) blades 13, 13, 13 are integrally formed on the outer peripheral surface of the hub 14.

Figure 1:
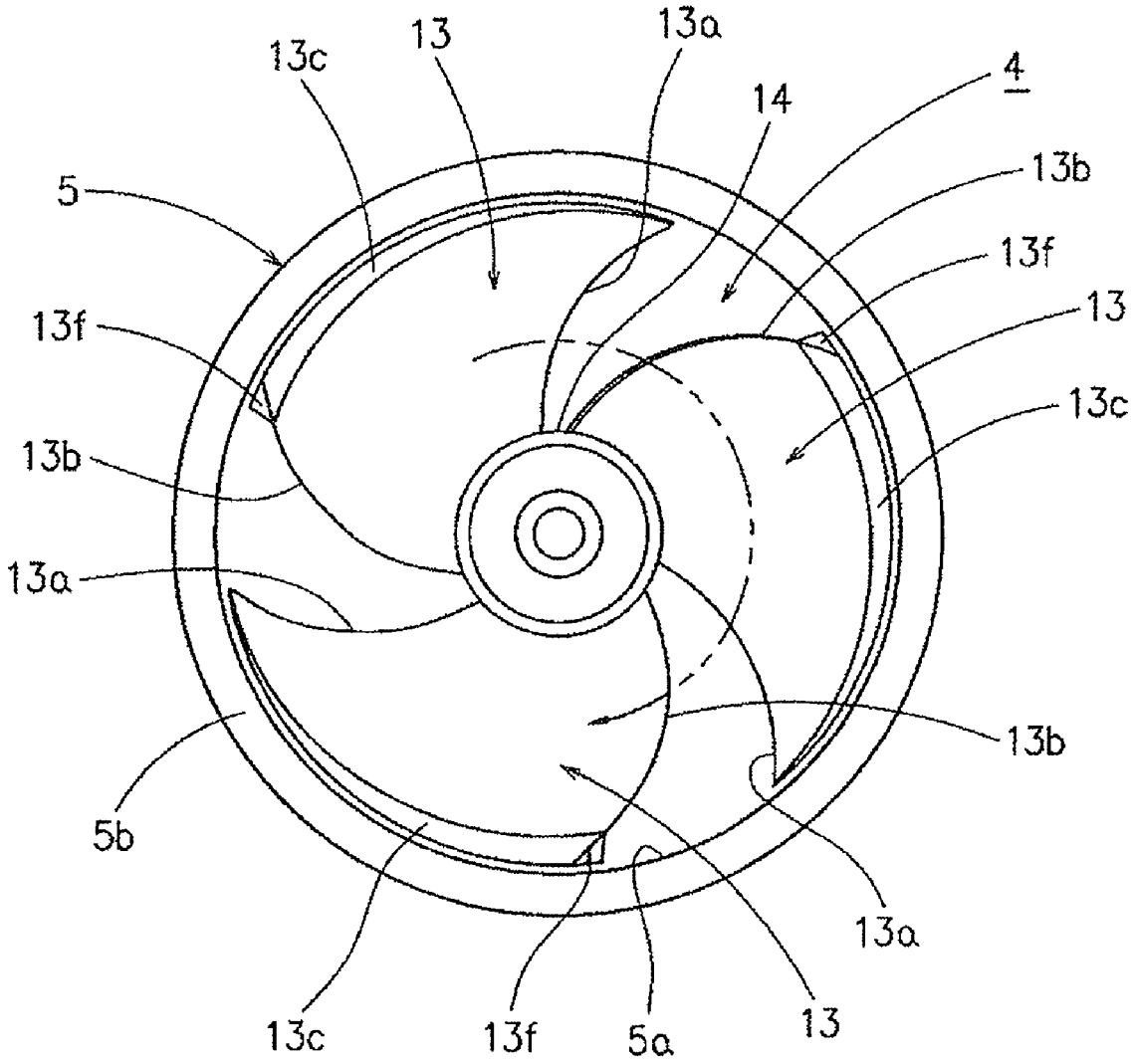
FIG. 1 is a rear view of a propeller fan pertaining to the best mode for implementing the present invention.
Figure 3:
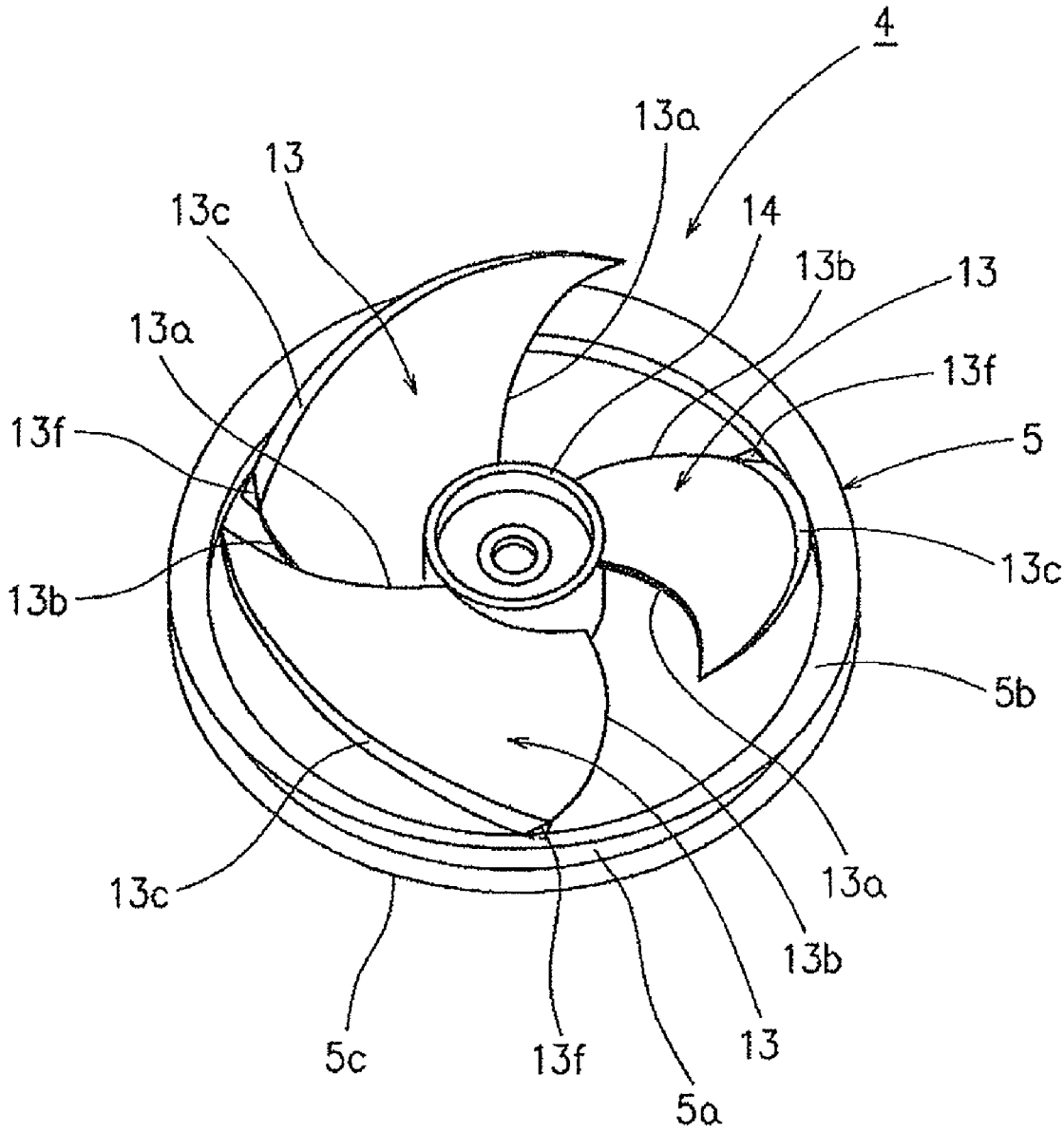
FIG. 3 is a perspective view seen from the backside of an impeller portion of the propeller fan.
Figure 4:
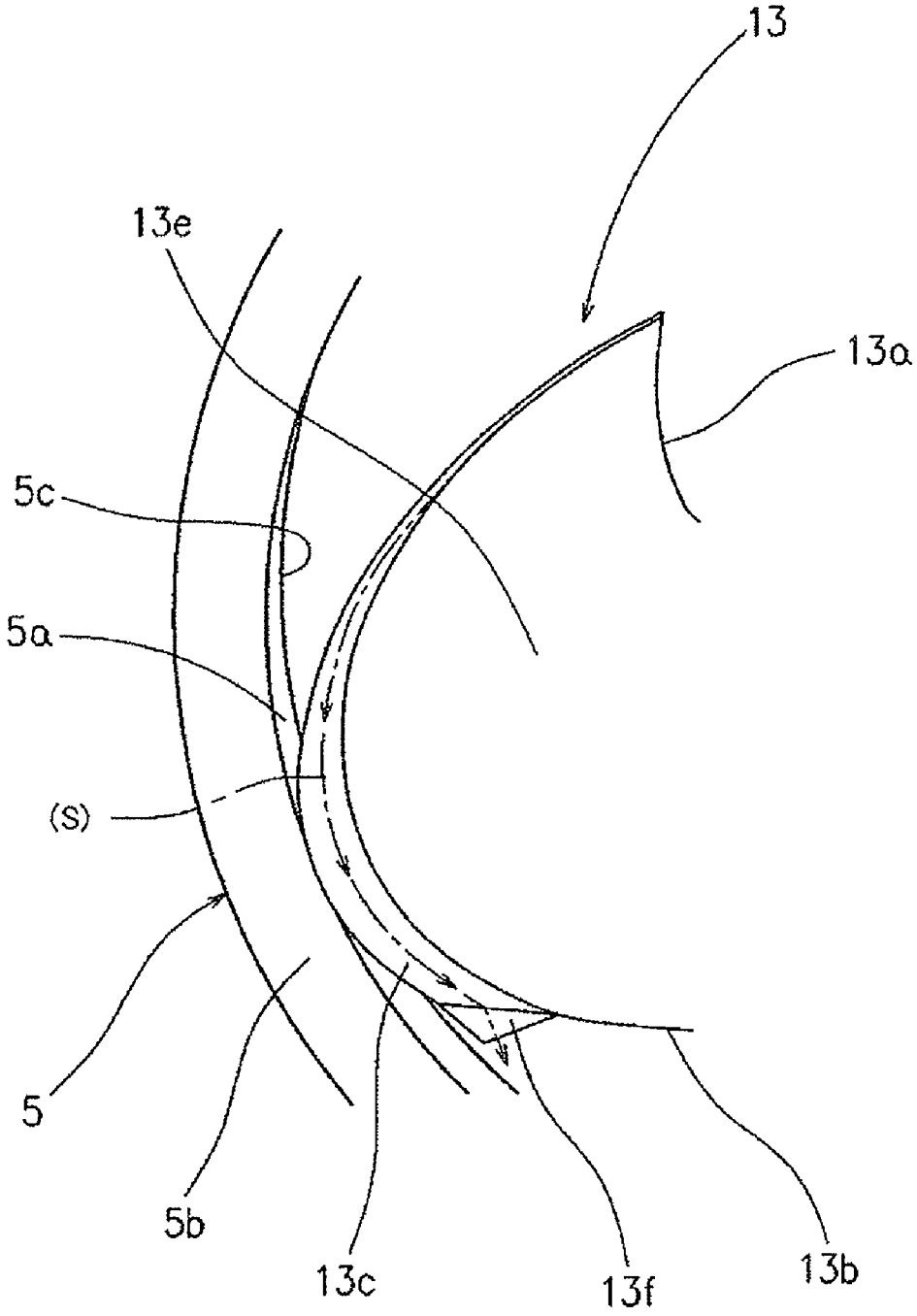
FIG. 4 is an enlarged view of relevant portions showing the relationship between the outer periphery of a blade of the impeller portion and a bellmouth.
Figure 5:
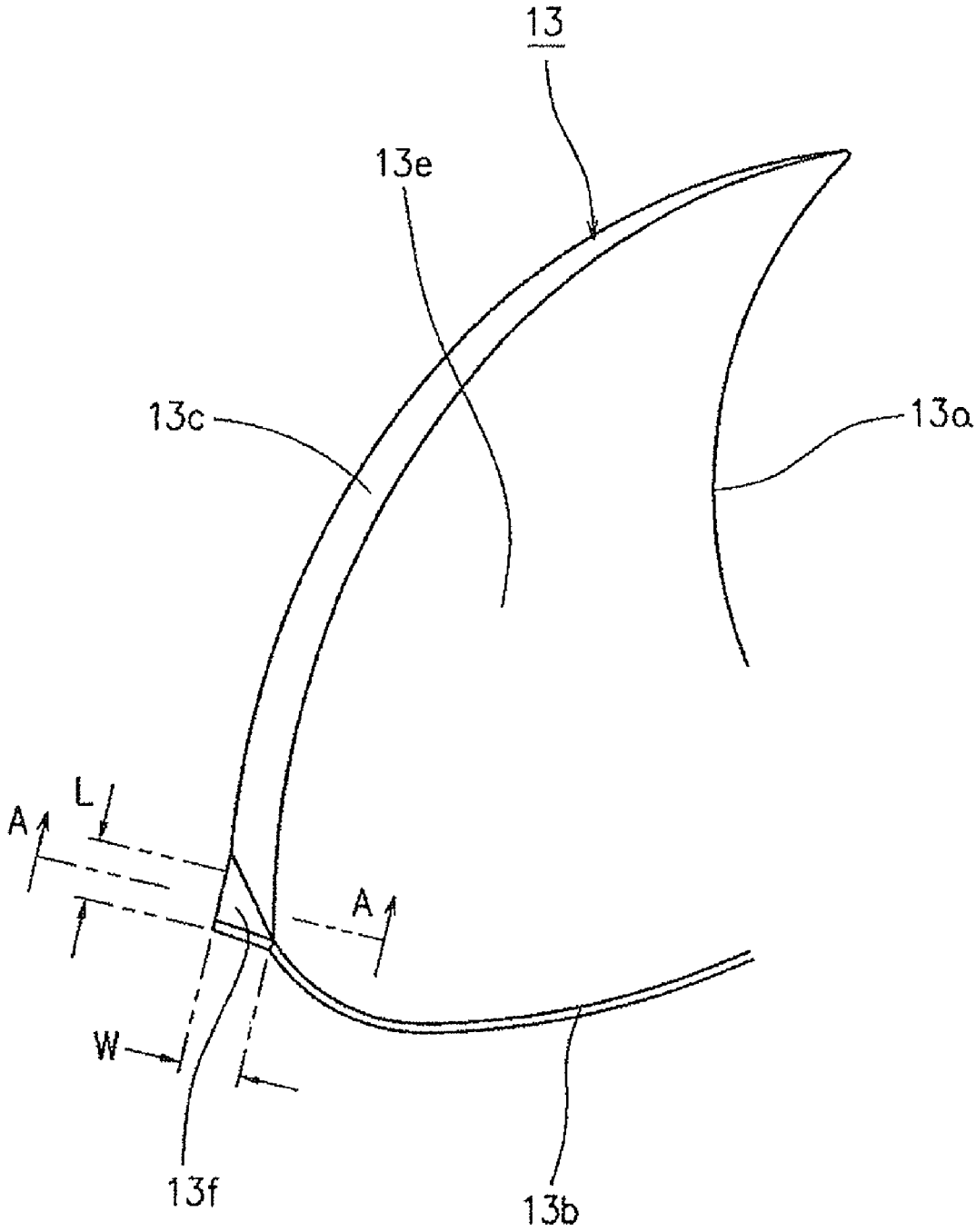
FIG. 5 is a plan view showing the shape of the relevant portion of the blade of the impeller portion.

As shown in FIG. 1 and FIG. 3, outer peripheral ends of front edges 13*a* and outer peripheral ends of rear edges 13*b* of the blades 13, 13, 13 are positioned further forward in the rotational direction of the blades 13 than inner peripheral ends thereof on the side of the hub 14. Further, as is shown in the drawings, the outer peripheral end portions of the blades 13, 13, 13 are bent a predetermined width towards negative pressure surface sides (suction sides) from the vicinities of the front edges 13*a* to the vicinities of the rear edges 13*b* as a result of bending them or folding them back, for example. As shown in FIG. 4 and FIG. 5, a radial direction width W of bent portions 13*c* is enlarged by a predetermined ratio gradually from the front edges 13*a* to the rear edges 13*b*.

In regard to the radial direction width W of the bent portions 13*c*, it is desirable for the maximum width portion at the rear edge 13*b* portion, for example, to be a dimension equal to or less than 15% of the radial direction length of the blades 13 from the rotational center of the blades 13 (i.e., the center of the hub 14) to the outer peripheral ends of the blades 13 in order to effectively control the aforementioned wing tip vortexes (Q) without lowering the blowing performance of the blades 13.

Additionally, in this embodiment, in regions near the rear edges of the bent portions 13*c* that are bent towards the negative pressure surfaces 13*e*, as shown in FIG. 4 to FIG. 6, there are disposed second bent portions 13*f* formed by bending part of the bent portions 13*c* further towards the negative pressure surfaces 13*e* by means such as bending. The second bent portions 13*f* are formed within the range of an axial direction length $L_0$ of the bellmouth 5 from a straight portion 5*a* to an outlet guide surface portion 5*c* excluding an inlet guide surface portion 5*b* of an inlet guide surface portion 5*b*~a straight portion 5*a*~an outlet guide surface portion 5*c* of an air suction opening in the bellmouth 5 surrounding the impeller (see FIG. 2 and FIG. 4).

Action of Blade Portion

As described above, the propeller fan 4 of the best mode for implementing this invention includes the bellmouth 5, and is disposed with the hub 14 that serves as the rotational center and the plural blades 13, 13, 13 disposed on the outer peripheral surface of the hub 14. The outer peripheral ends of the front edges 13*a* and the rear edges 13*b* of the plural blades 13, 13, 13 are positioned further forward in the rotational direction than the inner peripheral ends thereof. The propeller fan 4 is an axial flow fan where the outer peripheries of the blades 13, 13, 13 are bent towards the negative pressure surfaces from the front edges 13*a* thereof towards the rear edges 13*b* thereof, and in regions near the rear edges of the bent portions 13*c* that are bent towards the negative pressure surfaces 13*e*, there are disposed the second bent portions 13*c* formed by bending part of the bent portions 13*c* further towards the negative pressure surfaces 13*e*.

Figure 18:
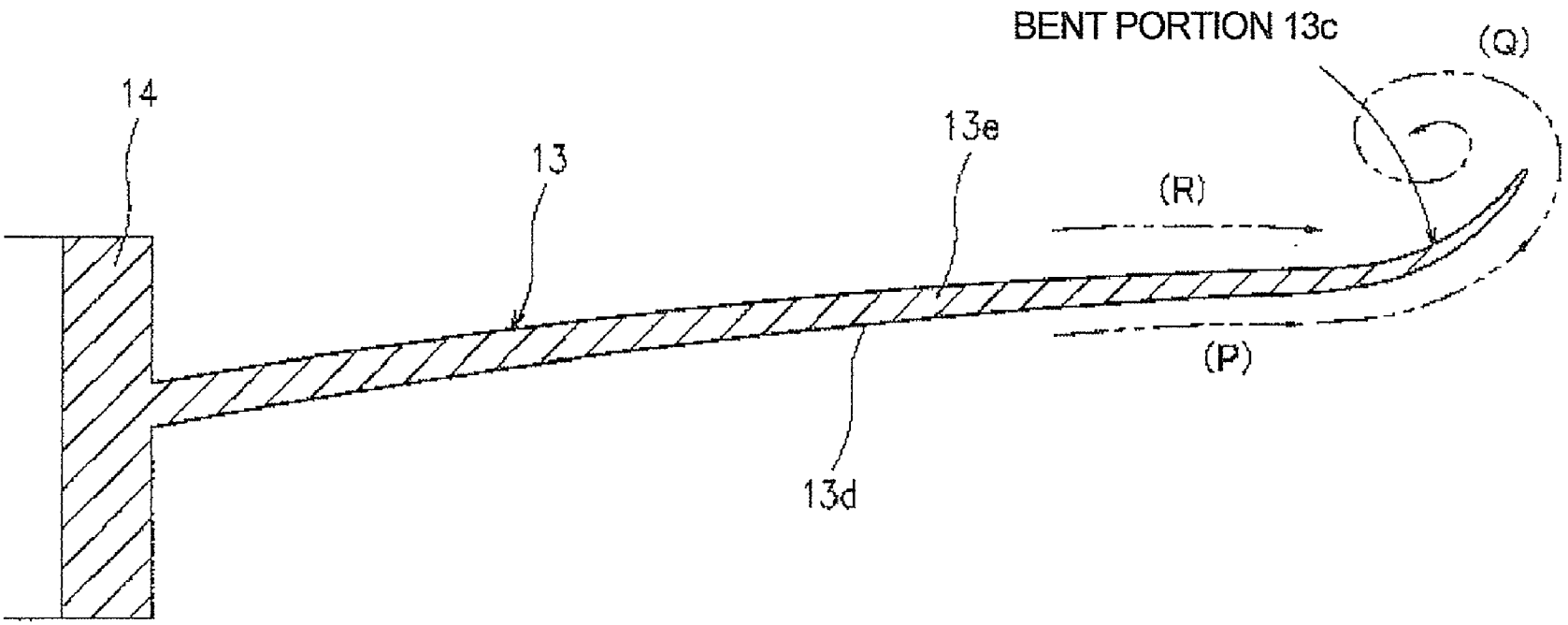
Prior Art Fig. 18
FIG. 18 is a cross-sectional view showing the wing tip vortex controlling action of the blades of the propeller fan of the conventional example.
Figure 19:
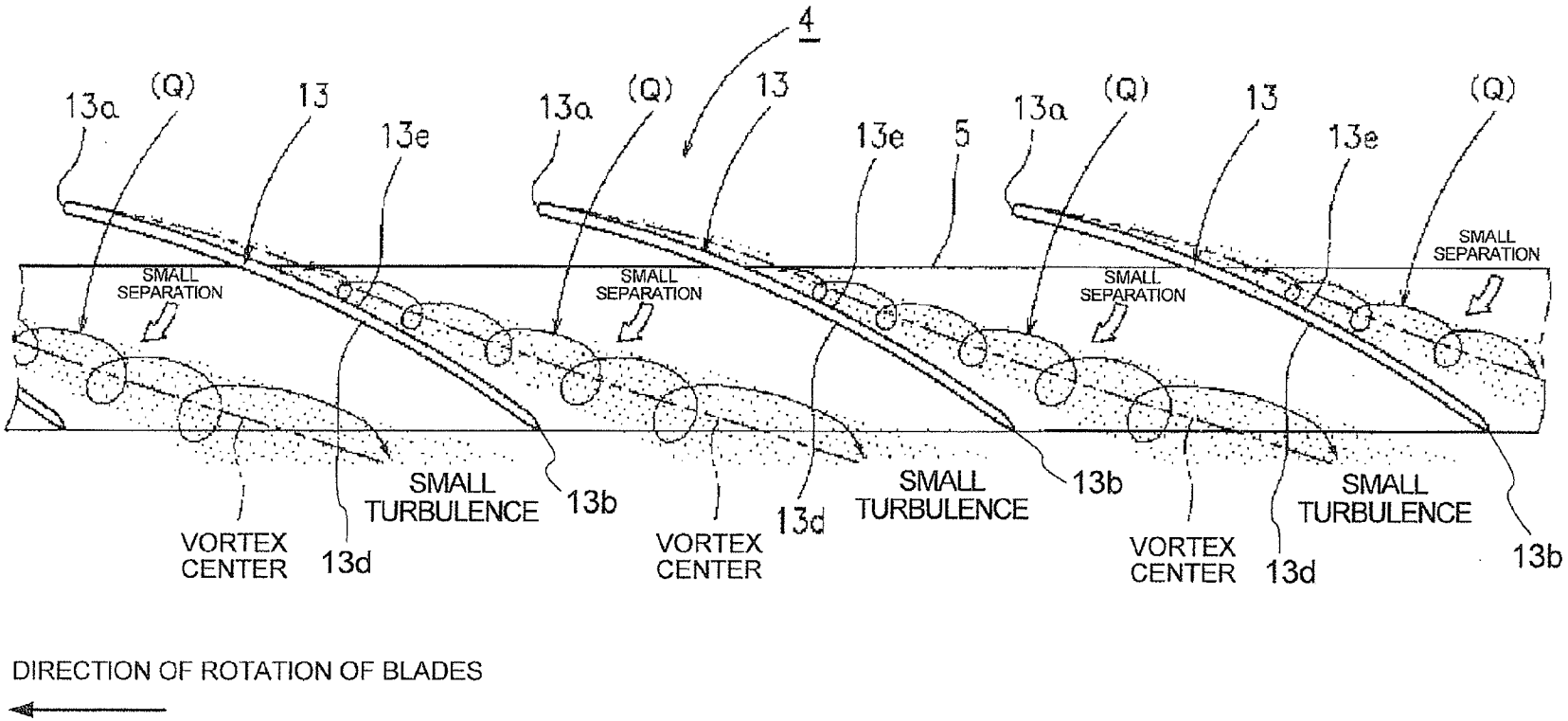
Prior Art Fig. 19
FIG. 19 is a descriptive view showing the action between adjacent wings of the blades of the propeller fan of the conventional example.

In this manner, in an axial flow fan such as a propeller fan having wings (forward-swept wings) where the outer peripheral ends of the front edges 13*a* and the rear edges 13*b* of the blades 13, 13, 13 are positioned further forward in the rotational direction than the inner peripheral ends thereof, the outer peripheries thereof are bent towards the negative pressure surfaces 13*e*. And, similar to the case of FIG. 18, for example, the airflows (P) on the pressure surfaces 13*d* of the blades 13 wind around into the wing tip concave negative pressure surfaces 13*e* smoothly along the outer peripheral end convex pressure surfaces 13*d* (see FIG. 18), the vortex diameters of the generated wing tip vortexes (Q) become small and stable, and the flows (S) of the airflows in the outer peripheral direction of the blades on the negative pressure surfaces 13*e* no longer interfere with the wing tip vortexes (Q).

Moreover, in regions near the rear edges of the bent portions 13*c* that are bent towards the negative pressure surfaces 13*e*, there are present the second bent portions 13*f* formed by bending part of the bent portions 13*c* further towards the negative pressure surfaces 13*e*, whereby, as shown in FIG. 7, for example, the axial flow fan becomes able to allow the aforementioned leakage flows (S) that arise at the portion surrounded by the bellmouth 5 to flow out downstream smoothly along the second bent portions 13*f*, so the axial flow fan can reduce as much as possible the vortex diameters thereof and can effectively control turbulence of the flows.

Moreover, by controlling the leakage flows (S) in this manner, the axial flow fan can also control aforementioned wing tip vortexes (Q) from approaching the following wings. Further, the axial flow fan can also control an increase in the strength of turbulence formed and an enlargement in the turbulence region as a result of the leakage flows (S) and the wing tip vortexes (Q) merging together.

As a result, the axial flow fan can realize, as much as possible, a reduction in blowing noise and greater efficiency.

Further, in the propeller fan 4, the radial direction width of the bent portions 13*c* from the front edges 13*a* to the rear edges 13*b* of the outer peripheries of the blades 13 is formed so as to become larger towards the rear edges 13*b*.

In this manner, when the radial direction width of the bent portions 13*c* is formed so as to become larger from the vicinities of the front edges 13*a* towards the rear edges 13*b*, the blades come to smoothly exhibit an effect across substantially the entire region from the front edges 13*a* to the rear edges 13*b* in correspondence to the vortex diameters of the wing tip vortexes (Q) that are gradually increased and whose vortex diameters are enlarged from the front edges 13*a* of the blades 13 to the rear edges 13*b*, and it becomes difficult for the generated wing tip vortexes (Q) to separate from the blade negative pressure surfaces 13*e*.

For that reason, even when the wing chord length has been shortened in order to make the blades 13, 13, 13 lightweight, for example, the wing tip vortexes (Q) no longer interfere with each other between the adjacent blades 13, 13, 13, and there is also less turbulence in the blowout airflows on the downstream side of the blower.

As a result, in this configuration, the aforementioned actions are effectively combined, so that noise when the axial flow fan is incorporated in an outdoor unit for an air conditioner becomes particularly effectively reduced.

Moreover, in the propeller fan 4, the second bent portions 13*f* are formed within the range of the axial direction length $L_0$ of the bellmouth 5 from the straight portion 5*a* to the outlet guide surface portion 5*c* excluding the inlet guide surface portion 5*b* of the inlet guide surface portion 5*b*~the straight portion 5*a*~the outlet guide surface portion 5*c* of the air suction opening in the bellmouth 5 surrounding the fan impeller.

As mentioned above, the leakage flows (S) arise at the portion surrounded by the bellmouth 5 and become stronger particularly at the straight portion 5*a* of the air suction opening in the bellmouth 5, and the turbulence thereof also becomes stronger downstream.

Figure 20:
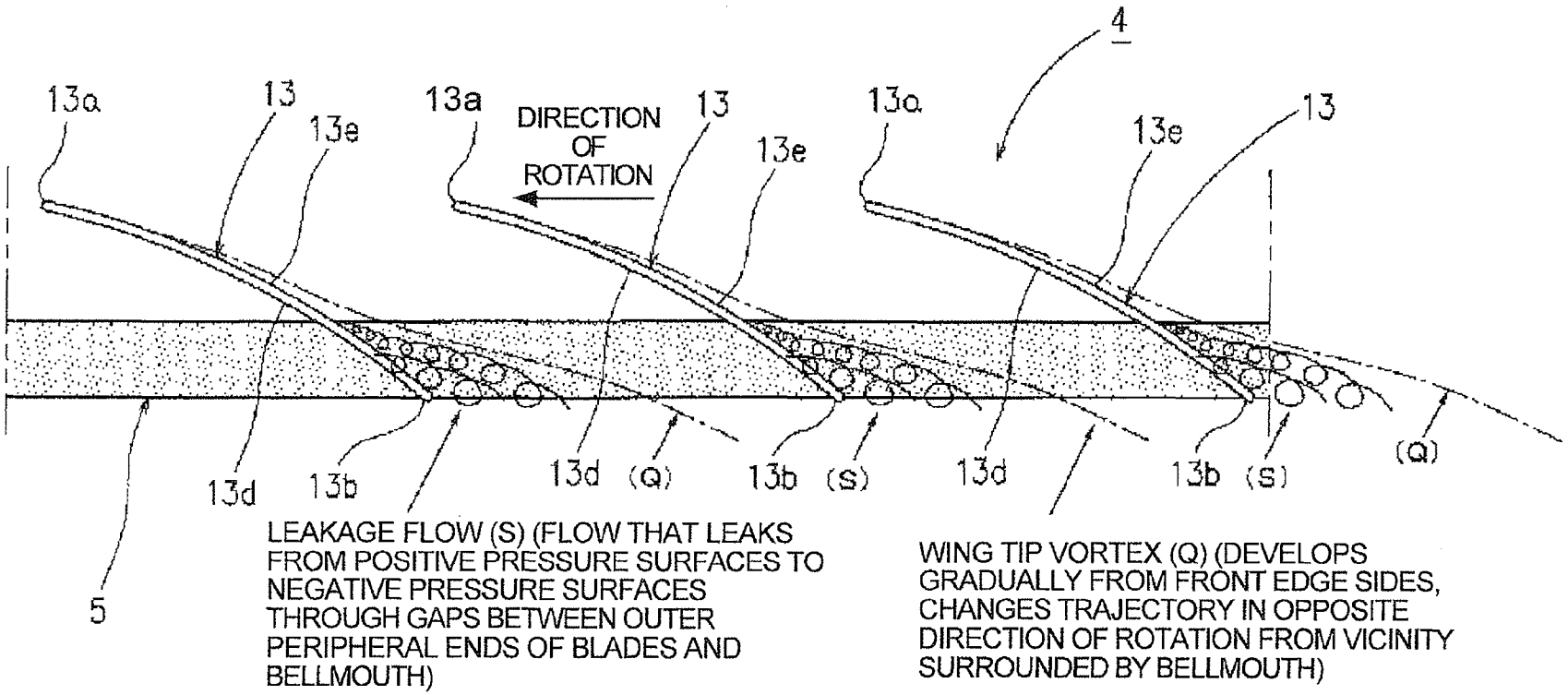
Prior Art Fig. 20
FIG. 20 is a descriptive view showing a new problem with the blades of the propeller fan of the conventional example.

Additionally, the wing tip vortexes (Q) that have developed from the front edges 13*a* of the blades 13 and the leakage flows (S) that pass through the gap between the bellmouth 5 and the blades 13 merge together at the portions of the straight portion 5*a* of the air suction opening in the bellmouth 5, whereby the trajectories of the wing tip vortexes (Q) suddenly change in a direction away from the negative pressure surfaces 13*e* at the inlet portion of the straight portion 5*a*, and thereafter the vortex scale thereof becomes larger (see FIG. 20).

Moreover, as described above, the leakage flows (S) leak out in the direction of the wing tip vortexes (Q) from the outer peripheral ends of the blades 13, so they fulfill the roll of causing the wing tip vortexes (Q) to move towards the following wings. As a result, there is also the potential for interference with the following wings.

Thus, by disposing the second bent portions 13*f* within the range of the axial direction length $L_0$ of the bellmouth 5 from the straight portion 5*a* to the outlet guide surface portion 5*c* downstream of the inlet guide surface portion 5*b* of the air suction opening in the bellmouth 5 where the leakage flows (S) and the wing tip vortexes (Q) merge together, the axial flow fan allows the leakage flows (S) to smoothly flow out in the most effective manner and reduces as much as possible the vortex scale of the aforementioned leakage flows themselves. Additionally, due to this, axial flow fan effectively controls the wing tip vortexes (Q) from separating from the wing negative pressure surfaces 13*e* and also effectively controls separation of the flows at the negative pressure surfaces 13*e* of the blade rear edges 13*b* (see FIG. 2 to FIG. 7).

As a result, the axial flow fan can realize a more effective blowing noise reduction and greater efficiency. Consequently, the axial flow fan becomes sufficiently effective also in the case of a high static pressure type of fan bellmouth, for example, where the axial direction length of the bellmouth 5 is large and in which it is easy for the scale of the turbulence resulting from the leakage flows (S) to become larger.

Incidentally, as will be apparent also from the above description, the leakage flows (S) that arise at the portion surrounded by the bellmouth 5 become stronger particularly at the portion of the straight portion 5*a* of the air suction opening in the bellmouth 5, and the turbulence thereof also becomes stronger downstream.

Consequently, as mentioned above, disposing the second bent portions 13*f* in the range of the axial direction length $L_0$ downstream (on the blowout side) of the straight portion 5*a* past the inlet guide surface portion 5*b* is effective.

Additionally, when the second bent portions 13*f* are formed within the range of the axial direction length $L_0$ of the bellmouth 5 from the straight portion 5*a* to the outlet guide surface portion 5*c* of the air suction opening in the bellmouth 5 in this manner, there is also the following advantage.

Figure 2:
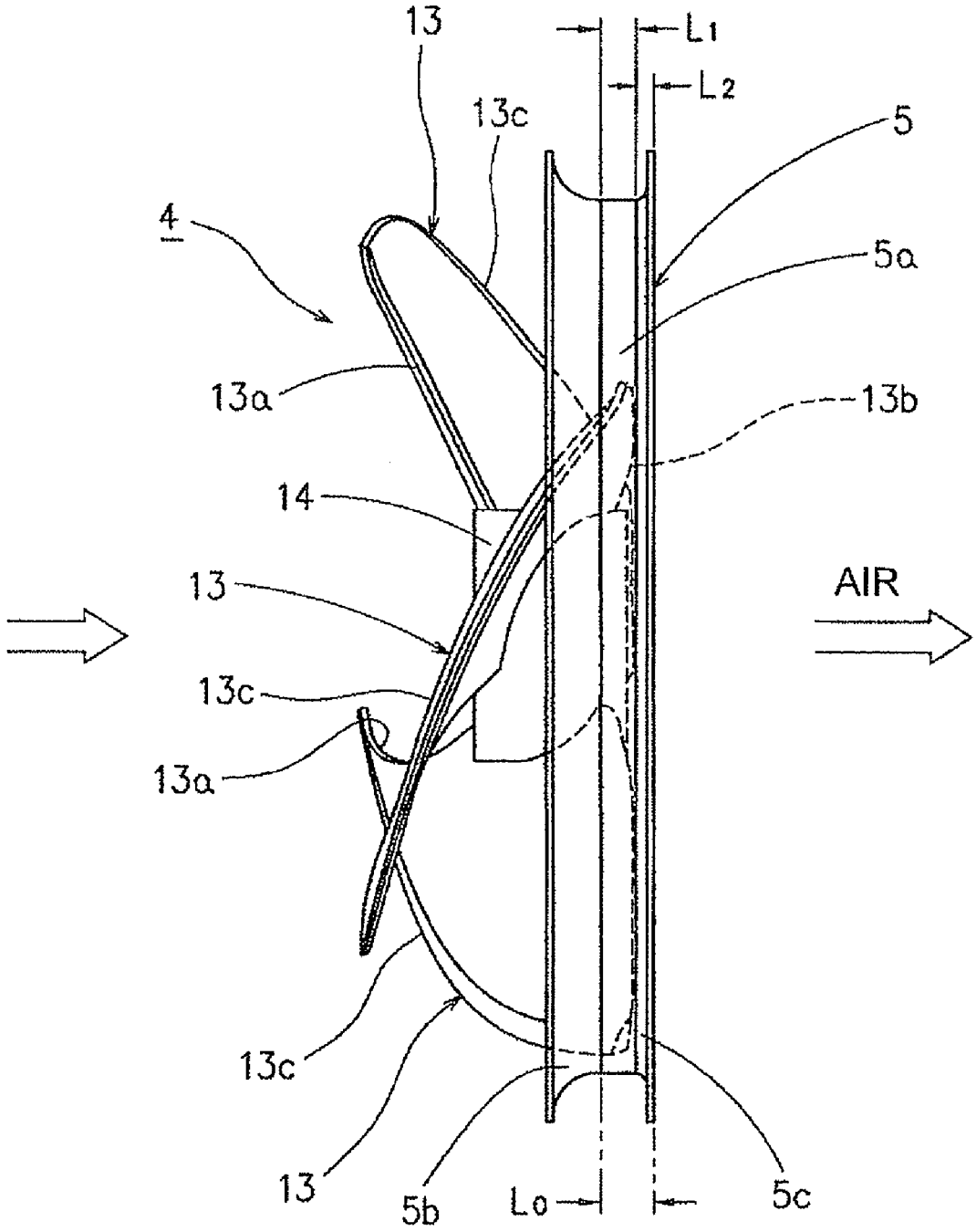
FIG. 2 is a side view of the propeller fan.

That is, depending on the case, a case is also conceivable where the second bent portions 13*f* are formed across both ranges ($L_1$+$L_2$) of an axial direction length $L_1$ of the straight portion 5*a* and an axial direction length $L_2$ of the outlet guide surface portion 5*c* in FIG. 2.

For example, this is a case where the fan impeller moves just the distance $L_2$ towards the blowout side and where the rear edges 13*b* of the blades 13 and the blowout side surface of the outlet guide surface portion 5*c* of the air suction opening in the bellmouth 5 coincide.

Even in such a case, as long as the second bent portions 13*f* are within the range of the axial direction length $L_0$ of the bellmouth 5 from the straight portion 5*a* to the outlet guide surface portion 5*c* of the bellmouth air suction opening as mentioned above, completely similar to the aforementioned case, the effect of allowing the leakage flows (S) to flow out smoothly can be obtained.

As described above, according to the propeller fan 4 of the present embodiment, the axial flow fan can effectively control the wing tip vortexes from separating from the wing negative pressure surfaces due to the leakage flows (S) that pass through the gap between the outer peripheral portions of the blades 13 and the bellmouth 5 and flow out from the pressure surfaces 13*d* of the blades 13 towards the negative pressure surfaces 13*e*.

Consequently, the axial flow fan can reduce as much as possible the scale of the wing tip vortexes on the final end of the impeller and can also effectively control separation of the flows at the negative pressure surfaces 13*e* of the blade rear edges.

As a result, the axial flow fan can realize as effective a reduction in blowing noise as possible and an improvement in blowing performance.

First Modification

Next, FIG. 8 shows the configuration of a blade portion of an impeller of a propeller fan 4 pertaining to a first modification of the best mode for implementing the present invention.

In this example, the length L of the second bent portions 13*f* is made longer in comparison to that in the preceding best mode for implementation. Thus, the length L of the second bent portions 13*f* is configured to correspond to substantially the entire axial direction length $L_0$ of the bellmouth 5 from the straight portion 5*a* to the outlet guide surface portion 5*c* excluding the inlet guide surface portion 5*b* of the air suction opening in the bellmouth 5.

In regard to a width $W_0$ at the rear edges 13*b* of the blades 13, it is the same as that in the best mode for implementation.

According to this configuration also, the aforementioned action and effects that are substantially the same as those of the configuration in the preceding best mode for implementation can be obtained.

Second Modification

Next, FIG. 9 shows the configuration of a blade portion of an impeller of a propeller fan 4 pertaining to a second modification of the best mode for implementing the present invention.

In this example, in a case where the width W of the bent portions 13*c* of the outer peripheries of the blades 13 has been made wider than that in the best mode for implementation, second bent portions 13*f* whose width $W_0$ and length L at the rear edges 13*b* of the blades 13 are the same as those in the preceding best mode for implementation are disposed.

According to this configuration also, the aforementioned action and effects that are substantially the same as those of the configuration in the preceding best mode for implementation can be obtained.

Third Modification

Next, FIG. 10 shows the configuration of a blade portion of an impeller of a propeller fan 4 pertaining to a third modification of the best mode for implementing the present invention.

In this example, the bent portions 13*c* that are disposed across the entire bodies of the blades 13 from the front edges 13*a* to the rear edges 13*b* of the outer peripheries of the blades 13 in the best mode for implantation are, rather than being disposed across the entire bodies, disposed across the blades 13 from a predetermined position between the front edges 13*a* and the rear edges 13*b* of the outer peripheries of the blades (e.g., a position about 25 to 30% from the front edges 13*a* towards the rear edges 13*b*) to the rear edges 13*b*.

In this configuration, even when the second bent portions 13*f* that fulfill the aforementioned role are disposed, substantially the same action and effects as those of each of the preceding examples can be obtained.

Regarding Types of Blades

In the preceding embodiment and its modifications, in each instance a case has been described where the blades had a thin wing structure.

However, the target to which the invention of this application may be applied is not limited to blades having such a thin wing structure; for example, the invention can be employed in completely the same manner in all thick wings and in cases where the wings are thick such as various types of airfoil wings whose aerodynamic performance has been further improved.

What is claimed is:

1. An axial flow fan, comprising:

a bellmouth having a straight portion, an outlet guide surface, and an inlet guide surface; and a plurality of blades, each of the blades having a first bent portion and a second bent portion, the first bent portion being disposed along an outer periphery of the blade and bent towards a negative pressure surface thereof, the second bent portion being disposed near a rear edge of the first bent portion and formed by bending a part thereof further towards the negative pressure surface, the second bent portion being formed within a distance along an axial direction of the bellmouth between the outlet guide surface and the straight portion.

2. The axial flow fan of claim 1, wherein the first bent portion extends from a front edge of the blade to a rear edge of the blade.

3. The axial flow fan of claim 1, wherein the first bent portion extends from a predetermined position between a front edge of the blade and a rear edge of the blade.

4. The axial flow fan of claim 1, wherein the first bent portion has a width that gradually increases towards a rear edge of the blade.

* * * * *